United States Patent [19]

DeFrancisco

[11] Patent Number: 4,696,158

[45] Date of Patent: Sep. 29, 1987

[54] INTERNAL COMBUSTION ENGINE OF POSITIVE DISPLACEMENT EXPANSION CHAMBERS WITH MULTIPLE SEPARATE COMBUSTION CHAMBERS OF VARIABLE VOLUME, SEPARATE COMPRESSOR OF VARIABLE CAPACITY AND PNEUMATIC ACCUMULATOR

[76] Inventor: Roberto F. DeFrancisco, Cra. 6a. No. 30A-30, 2nd Floor, c/o Ingetec, Bogota, D. E., Colombia

[21] Appl. No.: 789,772

[22] Filed: Oct. 18, 1985

Related U.S. Application Data

[63] Continuation-in-part of Ser. No. 431,733, Sep. 29, 1982, abandoned.

[51] Int. Cl.[4] ..... F02G 1/02

[52] U.S. Cl. ..... 60/39.62; 60/727; 60/729

[58] Field of Search ..... 60/39.6, 39.62, 39.63, 60/727, 728, 729; 123/48 A, 48 AA, 78 AA, 575, 576; 417/243, 274, 295

[56] References Cited

U.S. PATENT DOCUMENTS

| | | | |
|---|---|---|---|
| 809,081 | 1/1906 | Williams | 60/39.62 |
| 1,081,176 | 12/1913 | Wainwright | 417/295 X |
| 1,713,709 | 5/1929 | Moon | 60/39.6 X |
| 1,997,476 | 4/1935 | Wallene | 417/274 |
| 2,142,621 | 1/1939 | Tsuneda et al. | 123/48 AA |
| 2,765,976 | 10/1956 | Stewart | 417/243 |
| 2,793,629 | 5/1957 | Neely | 123/576 |
| 2,854,187 | 9/1958 | Crooks | 417/274 |
| 3,939,652 | 2/1976 | Hubers | 60/39.63 |
| 4,369,623 | 1/1983 | Johnson | 60/39.6 |

FOREIGN PATENT DOCUMENTS

| | | | |
|---|---|---|---|
| 326520 | 2/1903 | France | 60/39.62 |

*Primary Examiner*—Michael Koczo
*Attorney, Agent, or Firm*—Browdy and Neimark

[57] ABSTRACT

An engine has a compressor of variable capacity under command of a control system that regulates the output of the compressor for maintaining constant, at an adjustable value, the air pressure supplied from the compressor to plural combustion chambers of variable volume. A control system regulates the volume of the chambers in proportion to the charge of fuel injected in order to maintain constant, at an adjustable value, the air/fuel ratio at any load of the engine. Power cylinders are each provided with a reciprocating piston driven by combustion gases, each power cylinder being associated with at least two combustion chambers that are alternately fired, and from which combustion gases pass through valvings to the respective power cylinder. An accumulator stores compressed air during a braking mode of operation for subsequent use during super-power output modes of operation.

3 Claims, 4 Drawing Figures

FIG. 2 TYPICAL PROGRAM OF OPERATION FOR ANY ONE OF THE CYLINDERS/ALTERNATIVE WITH TWO COMBUSTION CHAMBERS PER CYLINDER AND EXHAUST VALVE LOCATED RIGHT OFF OF THE CYLINDER

| | Stroke Sequence | First Inlet Valve 46 | First Combustion Chamber 40 | First Discharge Valve 48 | Power Cylinder 14 | Second Discharge Valve 48 | Second Combustion Chamber 40 | Second Inlet Valve 46 | Exhaust Valve 50 |
|---|---|---|---|---|---|---|---|---|---|
| Typical cycle No. 1 | 1 (up) | Open | Blow out / Air filling | Open / Close | Exhaust | Close | Fuel Injection Combustion | Close | Open |
| | 2 (down) | Close | Fuel Injection Combustion | Close | Work | Open | Discharge | Close | Close |
| | 3 (up) | Close | Fuel Injection Combustion | Close | Exhaust | Open / Close | Blow out / Air filling | Open | Open |
| | 4 (down) | Close | Discharge | Open | Work | Close | Fuel Injection Combustion | Close | Close |
| Typical cycle No. 2 | 1 (up) | Open | Blow out / Air filling | Open / Close | Exhaust | Close | Fuel Injection Combustion | Close | Open |
| | 2 (down) | Close | Fuel Injection Combustion | Close | Work | Open | Discharge | Close | Open |
| | 3 (up) | Close | Fuel Injection Combustion | Close | Exhaust | Open / Close | Blow out / Air filling | Open | Open |
| | 4 (down) | Close | Discharge | Open | Work | Close | Fuel Injection Combustion | Close | Close |

1) Other cylinders follow this same cycle at proper phase times so as to obtain a continuous and uniform work action.
2) Valves are cyclically operated by means of cam shafts or crank shafts or equivalent mechanisms. Non-return type valves may also be used as inlet valves.
3) The blow out period and/or the fuel injection period may be increased or decreased as required.

FIG. 3 TYPICAL PROGRAM OF OPERATION FOR ANY ONE OF THE CYLINDERS/ALTERNATIVE WITH TWO COMBUSTION CHAMBERS PER CYLINDER AND EXHAUST THROUGH EACH OF THE COMBUSTION CHAMBERS

| | Stroke Sequence | First Inlet Valve 46 | First Combustion Chamber 40 | First Discharge Valve 48 | First Exhaust Valve 50 | Power Cylinder 14 | Second Exhaust Valve 50 | Second Discharge Valve 48 | Second Combustion chamber 40 | Second Inlet Valve 46 |
|---|---|---|---|---|---|---|---|---|---|---|
| Typical cycle No. 1 | 1 (up) | Close / Open | Sweep out / Blow out | Open | Open | Exhaust | Close | Close | Fuel Injection Combustion | Close |
| | 2 (down) | Open / Close | Air Filling / Fuel Injection | Close | Close | Work | Close | Open | Discharge | Close |
| | 3 (up) | Close | Fuel Injection Combustion | Close | Close | Exhaust | Open | Open | Sweep out / Blow out | Close / Open |
| | 4 (down) | Close | Discharge | Open | Close | Work | Close | Close | Air Filling / Fuel Injection | Open / Close |
| Typical cycle No. 2 | 1 (up) | Close / Open | Sweep out / Blow out | Open | Open | Exhaust | Close | Close | Fuel Injection Combustion | Close |
| | 2 (down) | Open / Close | Air Filling / Fuel Injection | Close | Close | Work | Close | Open | Discharge | Close |
| | 3 (up) | Close | Fuel Injection Combustion | Close | Close | Exhaust | Open | Open | Sweep out / Blow out | Close / Open |
| | 4 (down) | Close | Discharge | Open | Close | Work | Close | Close | Air Filling / Fuel Injection | Open / Close |

1) Other cylinders follow this same cycle at proper phase times so as to obtain a continuous and uniform work action.
2) Valves are cyclically operated by means of cam shafts or equivalent mechanisms.
3) The blow-out period and/or the fuel injection period may be increased or decreased as required.

FIG. 4 OPERATION OF SERVO-VALVES AND SERVOMOTORS/CONTROL DIAGRAM FOR ENGINE OF FIGURE 1
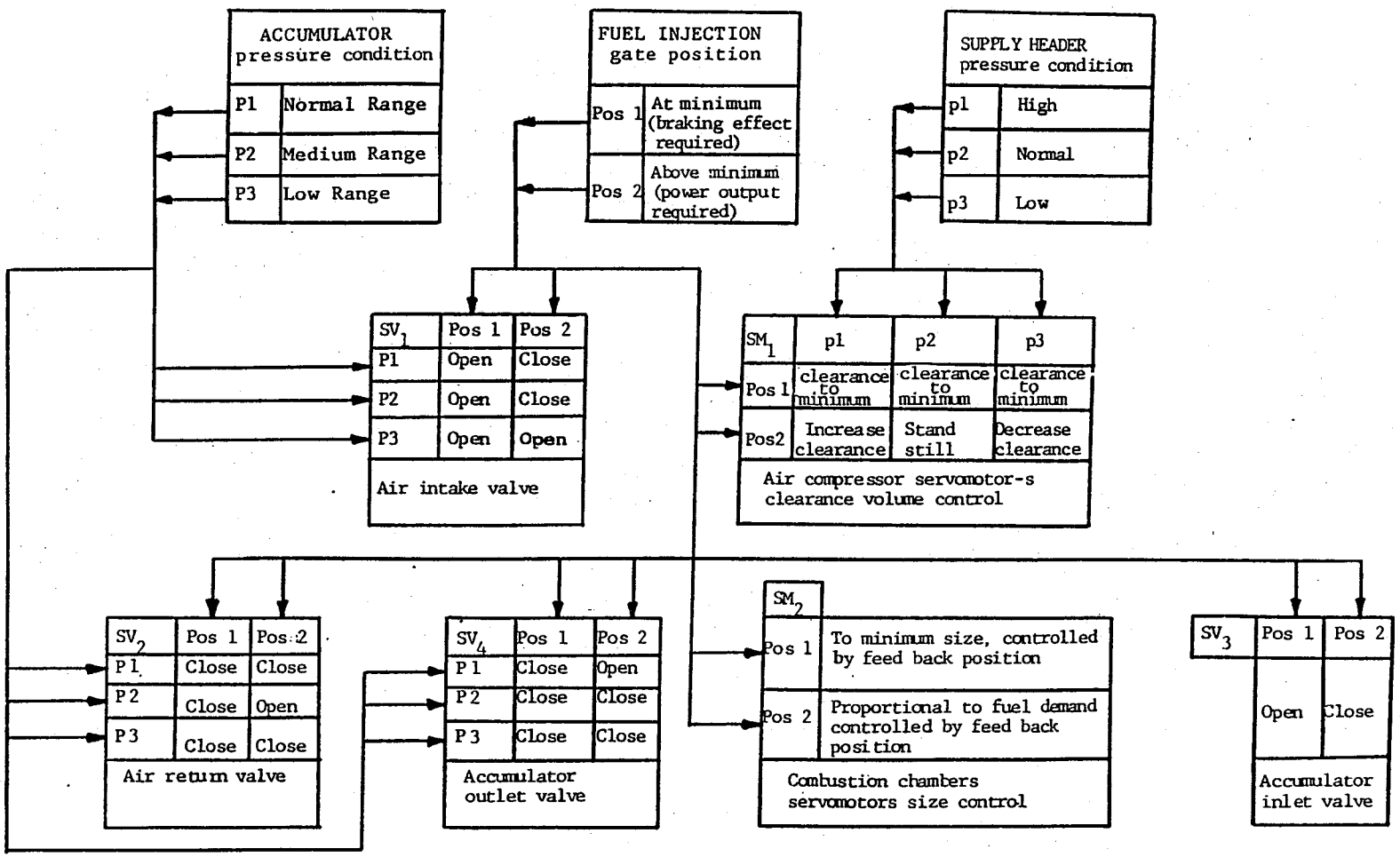

INTERNAL COMBUSTION ENGINE OF POSITIVE DISPLACEMENT EXPANSION CHAMBERS WITH MULTIPLE SEPARATE COMBUSTION CHAMBERS OF VARIABLE VOLUME, SEPARATE COMPRESSOR OF VARIABLE CAPACITY AND PNEUMATIC ACCUMULATOR

CROSS REFERENCE TO RELATED APPLICATIONS

This application is a continuation-in-part of U.S. application Ser. No. 431,733, filed Sep. 29, 1985, now abandoned.

BACKGROUND AND OBJECTS OF INVENTION

This present invention relates to a new development of internal combustion engines (i.e. where combustion takes place in the working fluid) of positive displacement type, which consists of the novel combination of elements, as described in the abstract and in the detailed description of the invention, having the following objects and outstanding performance that will become more apparent as this description proceeds:

(a) Availability of means to adjust, within a suitable range, the air pressure for filling the combustion chambers. This can be accomplished in the engine of the invention by setting the maximum and minimum clearance limits of the compressor cylinders respectively to the minimum and maximum volume limits of the combustion chambers.

(b) Capability to maintain constant the air pressure for filling the combustion chambers at the value previously selected and adjusted to obtain optimum thermal efficiency of the engine in accordance with the characteristics of the fuel used. This is achieved in the engine of the invention by increasing or decreasing automatically the clearance of the compressor cylinders in accordance with pressure signals from the header that conveys compressed air to the combustion chambers.

(c) Availability of means to adjust, within a suitable range, the air/fuel ratio. This can be accomplished in the engine of the invention by setting the maximum and minimum volume limits of the combustion chambers respectively to the maximum and minimum charge of fuel injected.

(d) Capability to maintain constant, at any load of the engine, the air/fuel ratio at the value previously selected and adjusted to obtain optimum thermal efficiency of the engine.

The selection of such value shall be done in accordance with the characteristics of the fuel used. This is achieved in the engine of the invention by increasing or decreasing automatically the volume of the combustion chambers in proportion to the charge of fuel being injected (i.e. according to the position of the accelerator pedal or other suitable signal from the fuel injection system) and maintaining at the same time constant the air pressure used for filling and pressurizing the combustion chambers prior to fuel injection.

In current compression-ignition diesel engines, the air/fuel ratio changes depending on the load demand; when the engine operates at low load an excess of air unneeded for combustion is drawn into the cylinder and therefore some work is wasted to compress that excess of air.

In current gasoline engines using a carburator with a throttling valve, a pressure drop takes place across such valve when the engine operates at low load, with the throttling valve partially closed, and therefore the final pressure obtained in the cylinder before spark ignition is lower than the pressure obtained when the engine operates at high load, with the throttling valve fully open.

(e) Availability of long periods of time within the operating cycle to achieve the fuel injection and combustion inside the combustion chambers with closed valves, so that no back pressure is passed to the power cylinders during exhaust strokes and no back pressure is passed to the compressor discharge header.

In the preferred embodiment of the invention having two combustion chambers associated with (or serving) each power cylinder, the total time available for fuel injection and combustion is equal to the time in which the power piston makes three strokes. Obviously, the fuel injection may be arranged to start at any time within such total period of time avaialble. The selection of the optimum time to start fuel injection will depend on the characteristics of the fuel used and/or the speed of rotation of the engine.

The long period of time available for fuel injection and combustion makes possible the use of heavier fuels (i.e. fuels that need more time to obtain complete combustion). Such long period of time within the operating cycle makes possible a higher speed of rotation of the engine as compared to other engines having a shorter period of time for combustion. The higher speed of rotation will permit a reduction in the size (or volumetric displacement) of the engine for the same given power output.

(f) Availability of means to obtain a regenerative braking. The compressor is used to slow down the engine and vehicle driven by the engine. During this braking mode the accumulator is used to store the compressed air delivered by the compressor for subsequent use when needed.

This is accomplished in the engine of the invention by increasing the capacity (or output) of the compressor and at the same time decreasing to a minimum the volume of the combustion chambers, so as to obtain an excess of compressed air not used for combustion that is passed to the accumulator. During this braking operation the power input required to drive the compressor is higher than the power output obtained from the power cylinders and therefore a negative power is obtained to slow down the engine and vehicle.

The compressed air stored in the accumulator can be used during periods of power demand (acceleration) to feed the combustion chambers with the necessary air, saving compression work in the power cycle and therefore obtaining more power output from the engine than in the normal operating mode in which the compressor has to do work.

The compressed air stored in the accumulator can also be used to feed the compressor, which will increase the clearance of its cylinders, saving compression work and obtaining more power output from the engine.

Above operations of super power output are accomplished by the engine of the invention by means of a valve that closes the intake header of the compressor and/or by increasing the clearance of the compressor cylinders as much as required to obtain proper air pressure in the discharge header which feeds the combustion chambers.

(g) Possibility to use the engine as a compressor driven by the power cylinders.

(h) Availability of compressed air stored in the accumulator to start the engine or for other use if required.

BRIEF DESCRIPTION OF THE DRAWINGS

FIGS. 2 and 3 are programs or cycle charts illustrating the sequence of operations that take place in one of the power cylinders and its two associated combustion chambers, indicating also the position of the various associated valves, during two complete (identical) cycles, of four strokes each, of operation of the power cylinder.

FIG. 2 relates to an alternative of the invention, from that shown in FIG. 1, where the exhaust is directly from the power cylinder.

FIG. 3 relates to another alternative where the exhaust is via the combustion chambers, in alternate manner through one and the other chamber, to achieve a sweeping out and cleaning effect of the chambers.

FIG. 4 is an operation chart showing the manner of operation and control of the various servovalves and servomotors to obtain the main modes of operation of the engine of FIG. 1, depending on the pressure conditions at the accumulator and at the compressed air header, and also from the action of the driver who controls the position of the so called fuel injection gate (or accelerator pedal).

DETAILED DESCRIPTION OF THE INVENTION

Figure 1:
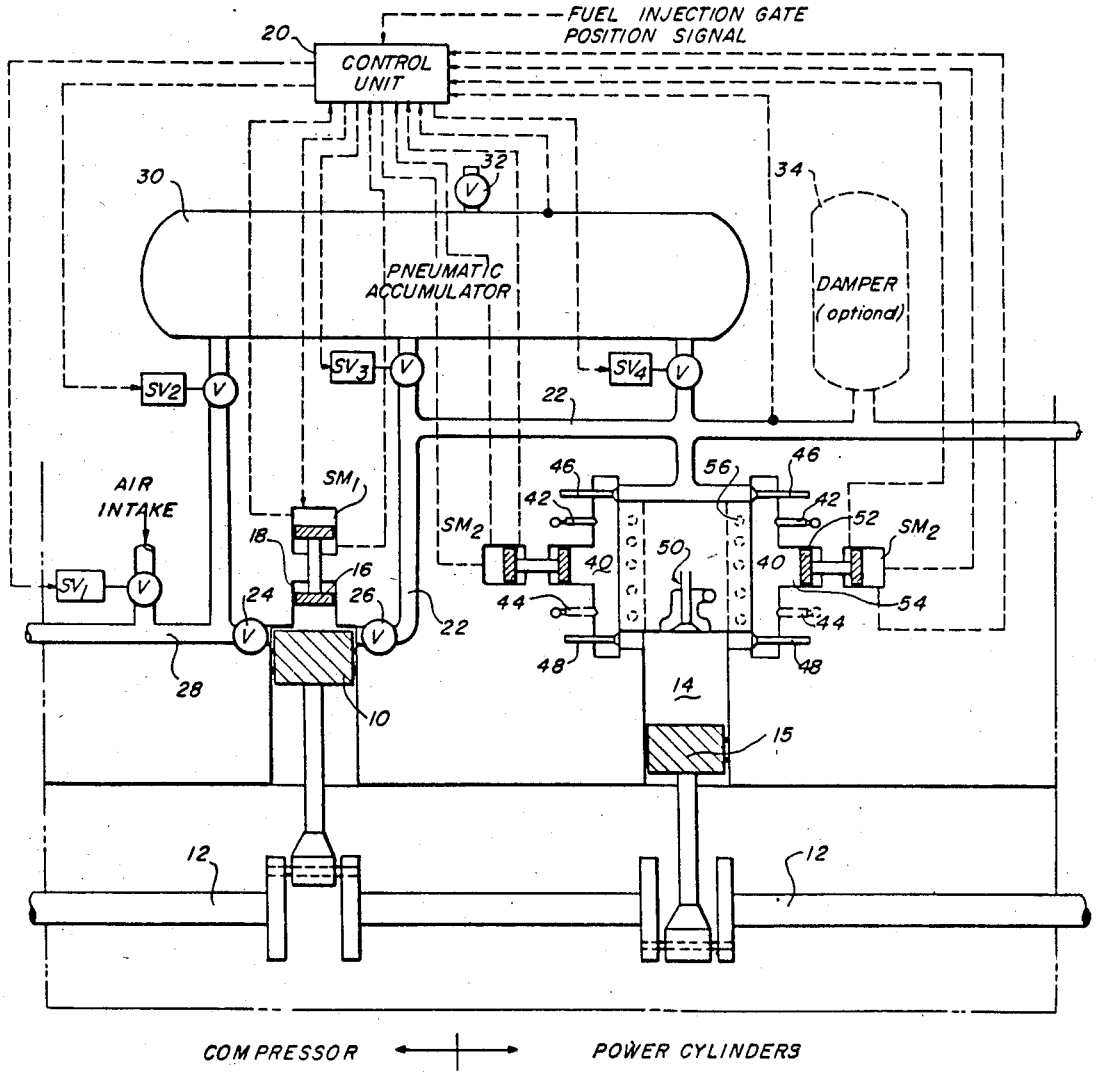
FIG. 1 is a diagrammatic view of a preferred embodiment of the engine of the invention showing squematically in cross section one of the compressor's cylinders, the accumulator and one of the power cylinders with its two associated separate combustion chambers of variable volume. The control unit which regulates the operation of the engine is diagramatically illustrated as a black box which receives input pressure signals and position signals from different parts of the engine and gives orders to the various servomotors and servovalves to do their functions.

Referring to FIG. 1, the system of the invention consists of the combination of the following elements:

An air compressor of variable capacity comprising one or more cylinders each with a reciprocating piston 10 operatively connected by means of a piston rod to the crankshaft 12, which drives the compressor.

At the upper part of the compressor cylinder another smaller cylindrical portion 18 with piston 16 are provided to permit increasing or decreasing the clearance volume of the compressor cylinder, so as to regulate the amount of compressed air delivered by the compressor. Consequently the work of compression will also be decreased or increased, respectively.

The position of piston 16 inside its cylinder 18 can be changed by means of a suitable servomotor SM1 under command of the control unit 20.

Air is drawn by the action of piston 10 into the compressor cylinder through an air intake header 28 having a servovalve SV1, which is normally open but will close during periods of super power output mode as indicated later below.

The compressor cylinder is provided as usual with an inlet valve 24 and an outlet valve 26, to permit entrance of air during the down-stroke of piston 10 and discharge of compressed air from the cylinder during the up-stroke. The compressed air is forced into a header 22 having duct branches leading to the inlets of the combustion chambers 40 and also to the accumulator tank 30. The duct branches which communicate with the accumulator are provided with servovalves SV3 and SV4 which remain closed during normal power output mode. The servovalve SV3, under command of control unit 20, will open during a braking mode (which depends on the action of the driver) to permit compressed air to be passed into accumulator 30. The servovalve SV4, under command of control unit 20, will open during a super power output mode to permit flow of compressed air stored in the accumulator to the combustion chambers. During this mode the servovalve SV1 at the intake will close, by command of control unit 20, to isolate the compressor to save compression work, and therefore obtaining more power output from the engine. The following conditions shall be fulfilled to permit this super power output mode to proceed: the air pressure available in the accumulator shall be within a certain range, high enough to obtain proper combustion of fuel; the driver who controls the position of the fuel injection gate or accelerator pedal shall depress this pedal and/or give some other signal to control unit 20 which will permit servovalve SV4 to open and SV1 to close.

The engine is provided with one or preferably more power cylinders 14 each having a reciprocating piston 15 operatively connected by means of a piston rod to the crank shaft 12.

Each power cylinder is provided with two separate combustion chambers 40 of variable volume. These chambers communicate with the respective power cylinder at the upper part. Each combusion chamber is provided with a cylindrical portion 54 having a piston 52 connected to a servomotor SM2 under command of the control unit 20. The volume of the combustion chamber is increased or decreased automatically (by control unit 20) by changing the position of piston 52 in proportion to the fuel charge being injected to the chamber in order to keep constant the air/fuel ratio previously selected and adjusted. Suitable means may be provided in control unit 20 to adjust the air/fuel ratio to the desired value. The measure of the fuel charge being injected may be obtained from the position of the accelerator pedal (or the so called fuel injection gate) or any other suitable input signal to the control unit which commands servomotors SM2 to change the position of pistons 52 accordingly.

Each combustion chamber is provided with a fuel injector 42 to inject the desired charge of fuel to the chamber at appropriate times during the cylce.

Another optional fuel injector 44 may be provided, if required, to operate as follows: fuel injector 42 will be used with light fuel to start the engine from cold and to preheat by means of a heat exchanger 56 a heavy fuel that can be injected later using injector 44.

Each combustion chamber is provided with suitable valves, 46 at the inlet opening and 48 at the outlet opening. These valves are operated, by means of cams or other system, at appropriate times during the cycle to permit the following operations to take place in alternate manner between the two chambers, as indicated in the program chart of FIG. 2 or 3:

(a) With inlet valve open and outlet valve closed, entrance of compressed air from header 22 to fill the combustion chamber at proper pressure.

(b) Next, with inlet and outlet valves closed, fuel injection and combustion inside the chamber.

(c) Next, with inlet valve closed and outlet valve open, delivery of high pressure combustion gases to the power cylinder 14 during the downstroke of piston 15 to achieve a power stroke.

Each power cylinder is provided with an exhaust valve 50 which is operated, by means of a cam or other system, at appropriate times in the cycle to permit expulsion of gases from the cylinder during each upstroke of the piston 15, according to the program of FIG. 2.

As an optional alternative, the exhaust may be accomplished in alternating order from the combustion chambers, that is in alternating manner through one and the other chamber, with valves not shown in the FIG. 1, according to the program of FIG. 3.

As illustrated by the programs of FIGS. 2 and 3, the alternate operation between the two combustion chambers, of each power cylinder, permits a long period of time within the cycle to achieve the fuel injection and combustion inside the chambers with closed valves, and therefore not causing a negative effect on the power piston.

An air duct is provided to permit flow of compressed air from the accumulator to the intake header of the compressor during a super power output mode. This duct is provided with servovalve SV2, which remains closed during the normal power output mode.

During such super power output mode, servovalve SV2 will open and servovalve SV1 will close, under command of control unit 20, depending on the pressure available in the accumulator and also from the action of the driver, who controls the position of the fuel injection gate (or accelerator pedal) or any other suitable control. During this mode, the clearance of the compressor cylinders will be increased, as required, in accordance with the air pressure delivered by the accumulator, therefore saving compression work and increasing the power output of the engine.

The accumulator 30 is provided with a relief valve 32 for security in case the air pressure gets too high.

An optional tank 34 may be provided in communication with header 22 to dampen pressure fluctuations.

FIG. 4 indicates the main functions of control unit 20. This unit may be similar to an electro hydraulic speed governor of a hydraulic turbine, which controls the position of the needles of the jet injectors.

This unit 20 receives pressure signals from the header 22 and from the accumulator 30; feed back position signals from the servomotors SM1 and SM2; position signals from the servovalves SV1, SV2, SV3 and SV4; fuel injection gate position signals and/or other suitable signals from the action of the driver, and according to these signals the control unit commands the action of the servomotors and servovalves to achieve the following functions to permit the corresponding operating mode of the engine:

NORMAL POWER OUTPUT MODE

In this mode, servovalve SV1 will be open and servovalves SV2, SV3 and SV4 will be closed.

All the compressed air delivered by the compressor will be used in the combustion chambers.

The servomotors SM2 will increase or decrease the volume of the combustion chambers in proportion to the fuel charge being injected (which depends on the action of the driver), so as to keep constant the proper air/fuel ratio.

The servomotors SM1 will decrease or increase the clearance of the compressor cylinders in order to keep constant the proper air pressure in header 22 for filling the combustion chambers.

BRAKING MODE

In this mode, the action from the driver will decrease the fuel injection to a minimum and therefore servomotors SM2 will automatically decrease the volume of the combustion chambers to a minimum to keep the air/fuel ratio as before. Servovalve SV3 will open to permit flow of compressed air to the accumulator 30. Servomotor SM1 will decrease the clearance of the compressor cylinders in order to increase the output of compressed air, and therefore the work of compression will also increase to a certain value that can be controlled by the driver.

During this mode of operation, the power output obtained from the power cylinders will be smaller than the power input required to drive the compressor and therefore a braking action will be obtained to slow down (decelerate) the engine and the vehicle driven by the engine.

SUPER POWER OUTPUT NO. 1

In order to operate in this mode, the air pressure available in the accumulator (from previous braking operations) shall be within a certain range, appropriate to fill the combustion chambers and achieve combustion of fuel.

A certain action from the driver will open servovalve SV4 to permit flow of air from the accumulator to the combustion chambers, and will close servovalve SV1 to isolate the compressor from the intake. The compressor will operate in vacuum and so the power input required to drive the compressor will be minimum, and therefore the power output obtained from the engine will be greater than in normal power output mode.

When the pressure in the accumulator decreases to a certain value servovalve SV1 will open and SV4 will close and servomotor SM1 will regulate the clearance of the compressor cylinders to maintain proper air pressure in header 22. At this moment the engine will be operating again in the normal mode.

SUPER POWER OUTPUT NO. 2

In order to operate in this mode, the air pressure available in the accumulator shall be within a certain range, lower than in mode No. 1.

A certain action from the driver will open servovalve SV2 and close SV1, to permit flow of air from the accumulator to the inlet of the compressor. Servomotors SM1 will regulate the clearance of the compressor cylinders to maintain proper air pressure in header 22. The higher be the air pressure received from the accumulator, the greater shall be the clearance of the compressor cylinders and the smaller will be the work required to compress air to the given pressure. Therefore, more power output will be obtained from the engine as compared to normal mode.

When the air pressure in the accumulator reaches atmospheric pressure, servovalve SV1 will open and SV2 will close. At this moment, the engine will be operating again in the normal mode.

COMPRESSOR MODE

In this mode all the power output obtained from the power cylinders may be used to drive the compressor and therefore an excess of compressed air will be obtained for other use.

In this mode, servomotors SM1 will decrease the clearance of the compressor cylinders to obtain an increase in the amount of compressed air delivered. Only a portion of the compressed air will be used for combustion. Servomotors SM2 will decrease the volume of the combustion chambers as required to obtain the necessary power output to drive the compressor.

What is claimed is:

1. An internal combustion engine comprising:

an air compressor of variable capacity, having means to change its clearance volume;

control means, pressure responsive, for regulating the output of said compressor for maintaining constant, at a certain adjustable value, the pressure of the compressed air supplied from said compressor for combustion purposes;

a pneumatic accumulator to store the compressed air from said air compressor during a braking mode of operation when the compressed air is not used for combustion purposes, for subsequent use of the stored compressed air during super power output modes of operation of the engine;

a plurality of combustion chambers of variable volume;

a discharge header coupled to said compressor to convey compressed air to said combustion chambers and having discharge header air duct branches leading to said accumulator;

an air duct to communicate said accumulator with an intake of said compressor;

servovalves provided at said air ducts of the accumulator;

said control means comprising means for: being effective during said braking mode of operation to open one of said servovalves for allowing compressed air to enter said accumulator; being effective during one of said super power output modes of operation to control respective ones of said servovalves for allowing the stored compressed air, when in a sufficiently high pressure range, to exit said accumulator and feed the combustion chambers described herein below; and being effective during other of said super power output modes of operation to control respective ones of said servovalves for allowing compressed air, when in a low pressure range, to exit said accumulator and feed said compressor;

power cylinders of positive displacement, each provided with a reciprocating piston driven by high pressure combustion gases during each power stroke, each of said power cylinders including exhaust valve means, for allowing combustion gases to exit the cylinder during the upstroke of said reciprocating piston, and having inlet openings for allowing high pressure combustion gases to enter the cylinder during power strokes;

said plurality of combustion chambers being located externally of said power cylinders, with at least two of said combustion chambers associated with each one of said power cylinders for supplying combustion gases alternately from said combustion chambers to the respective power cylinder;

fuel injection means with a fuel injection gate and valve means including inlet and outlet valves provided for each of said combustion chambers for allowing compressed air to enter the chamber, to achieve fuel injection and combustion with the inlet and outlet valves closed, and to supply the high pressure combustion gases to the respective power cylinder;

a cylindrical portion with a piston provided in each of said combustion chambers to vary by means of said piston the effective volume of the chamber;

a servomotor-operated mechanism to change the position of said piston of each combustion chamber; and said control means including means for being made adjustable and responsive to position of the fuel injection gate in said fuel injection means, for commanding said servomotor in order to change by means of said piston the volume of each of said combustion chambers in proportion to the fuel charge injected in the chamber, in this manner maintaining constant the air/fuel ratio at any load or power output of the engine.

2. An engine of claim 1, said air compressor and said power cylinders being engaged by a commonly extending drive shaft.

3. An engine, comprising:

air compression means for providing a variable compressed air output;

accumulator means for selectively storing or discharging some of said compressed air;

combustion means including pairs of combustion chambers each having means for varying the volume thereof;

power piston chambers means each communicating with one pair of said combustion chambers;

fuel injection means for injecting fuel into said combustion chambers;

valve means with inlet and outlet valves for: allowing compressed air to enter said combustion chambers; allowing combustion to take place inside said combustion chambers with the inlet and outlet valves closed; and allowing combustion gases to enter the power piston chamber associated with each pair of said combustion chambers alternating order from said pair of combustion chambers, to drive said power piston on each downstroke;

valve means for allowing the low pressure combustion gases to exit each of said power piston chambers on each upstroke; and control means for regulating: the compressed air output of said air compression means, to maintain thereby the pressure of the compressed air supplied to said combustion means in accordance with an adjustable reference value; and the volume of said combustion chambers in proportion to the charge of fuel injected into said combustion chambers, to maintaining thereby the air/fuel ratio in accordance with an adjustable reference value.

* * * * *